US008561355B2

(12) United States Patent
Canavarro

(10) Patent No.: US 8,561,355 B2
(45) Date of Patent: Oct. 22, 2013

(54) SYSTEM FOR EXTENDING THE HEIGHT OF CUBICLE WALLS

(76) Inventor: Mark Canavarro, Carlsbad, CA (US)

( * ) Notice: Subject to any disclaimer, the term of this patent is extended or adjusted under 35 U.S.C. 154(b) by 140 days.

(21) Appl. No.: 13/104,929

(22) Filed: May 10, 2011

(65) Prior Publication Data

US 2012/0285103 A1 Nov. 15, 2012

(51) Int. Cl.
*E04H 1/00* (2006.01)
*A47F 10/00* (2006.01)
*A47F 5/06* (2006.01)

(52) U.S. Cl.
USPC ..... 52/36.1; 52/27; 248/231.41

(58) Field of Classification Search
USPC ..... 52/27, 36.1, 38; 248/231.41, 231.61, 248/231.71; D8/355
See application file for complete search history.

(56) References Cited

U.S. PATENT DOCUMENTS 4,559,738 A * 12/1985 Helfman ..... 47/67
4,774,792 A * 10/1988 Ballance ..... 52/285.2
D307,286 S * 4/1990 Ginder ..... D16/242
5,031,660 A * 7/1991 Magee ..... 137/554
5,822,918 A * 10/1998 Helfman et al. ..... 47/39
5,984,249 A * 11/1999 Cohen ..... 248/226.11
6,533,019 B1 * 3/2003 King et al. ..... 160/351
6,772,567 B2 * 8/2004 Diffrient, Jr. et al. ..... 52/239
6,817,149 B2 * 11/2004 Diffrient et al. ..... 52/239
6,854,233 B2 * 2/2005 Pitsch et al. ..... 52/584.1
7,032,862 B2 * 4/2006 Landes et al. ..... 244/129.1
7,191,990 B2 * 3/2007 Hutter, III ..... 248/229.12
7,243,449 B2 * 7/2007 Wichmann ..... 40/606.01
7,391,624 B2 * 6/2008 Hutter, III ..... 361/810
8,251,443 B1 * 8/2012 Hahn et al. ..... 297/188.18
2004/0250480 A1 * 12/2004 Matthai ..... 52/36.1
2006/0096061 A1 * 5/2006 Weiland et al. ..... 16/102

* cited by examiner

*Primary Examiner* — Joshua J Michener
*Assistant Examiner* — Elizabeth A Plummer

(57) ABSTRACT

A system for extending the height of a cubicle wall is disclosed. The system comprises a vertical wall extender and a clamp. The clamp further includes an upper channel that receives the vertical wall extender, the upper channel further includes a fixing element that fixes the vertical wall extender to the upper channel, and a screw. The clamp also includes a lower channel that is mounted to the existing cubicle wall, the lower channel further includes two halves, the first half containing a nut channel with a nut disclosed therein, the second half containing a slot through which the screw can thread into the nut. Further improvements for the system are disclosed, along with a method for using the system.

16 Claims, 3 Drawing Sheets

SYSTEM FOR EXTENDING THE HEIGHT OF CUBICLE WALLS

1.0 BACKGROUND

Cubicles, also known as cubicle desks, office cubicles or cubicle workstations, offer a less expensive alternative to office design and layout. A cubicle is a partially enclosed workspace, separated from neighboring workspaces by partitions that are usually 4 to 8 feet tall. Its purpose is to isolate office workers from the sights and noises of an open workspace, the theory being that this allows workers more privacy, and personalization, and helps them to concentrate without distractions. Horizontal work surfaces are usually suspended from the vertical walls of cubicles, as is shelving, overhead storage, and other amenities. Within the cubicle walls often run conduits that carry electrical and communications lines (i.e., telephone and internet), allowing each cubicle easy connection as would be the case in a traditional office space.

Often the building housing the cubicles is a single large room, and the cubicle can be used to compartmentalize that large room into individual work areas. And as the needs of the company change, say for example more people are hired, then the existing cubicles can be reconfigured to accommodate the change. This is a marked difference from traditional office space design that would require the erection of permanent walls to create individual offices. Traditional office design would not allow the work space to accommodate the changes in the company needs, instead requiring very expensive demolition and relocation of permanent walls including all of the electrical and communication lines encased within those walls.

Existing cubicles come in a variety of vertical heights from 4 to 8 feet tall. Once the cubicle walls are installed, then several attachments can be made to those walls including shelves, bookcases, filing cabinet and desks. Also once installed an electrician will route the required electrical and communication lines through the cubicle wall conduits. Therefore, while cubicles are a flexible alternative accommodating changes in layout and design, there can be significant expense in disassembling and reconstructing the cubicles when certain accommodations are desired.

One such accommodation is extending the height of the existing cubicle wall. For example, a work space may be initially provisioned as a collaborative space requiring constant face time between peers such that lower 4 foot walls would be appropriate. However, that space may then be converted to a call center/customer service center requiring less collaboration and more separation (for example to lessen the amount of ambient noise to the customer when calling in).

Available cubicle design techniques and structure would require that shorter walls be replaced with taller walls. This, in turn, would require that the entire cubicle be disassembled (walls and attached horizontal surfaces), the internal wiring removed, new taller walls installed, new internal wiring run and the horizontal surfaces reinstalled. Not only is this expensive in installation labor and materials (i.e., new cubicle walls), it is also highly disruptive requiring the cubicles be off-line for several hours, if not days.

What is therefore needed is a system for quickly and inexpensively extending the height of vertical walls on a cubicle.

2.0 SUMMARY OF THE INVENTION

What is disclosed herein is a system for extending the height of a cubicle wall. The system comprises a vertical wall extender and a clamp. The clamp further includes and upper channel that receives the vertical wall extender, the upper channel further includes a fixing element that fixes the vertical wall extender to the upper channel, and a screw. The clamp also includes a lower channel that is mounted to the existing cubicle wall, the lower channel further includes two halves, the first half containing a nut channel with a nut disposed therein, the second half containing a slot through which the screw can thread into the nut. The fixing elements may be a screw, and the screws used in the clamp may be allen screws. The lower channel may have protrusions to help stabilize the mount to the existing cubicle wall. The slot in the lower channel may be elongated so as to allow the position of the upper channel to be adjusted. And the nut channel may further include a plug or a narrowing so as to prevent the nut from escaping the nut channel.

A method of installing the system is also disclosed. The method includes adjusting the lower channel halves so as to receive the cubicle wall, sliding those halves towards each other, adjusting the position of the upper channel and tightening the screw. Then the vertical wall extender can be inserted into the upper channel and the fixing element can be actuated to fix the vertical wall extender to the upper channel, which in turn is fixed to the clamp.

3.0 DESCRIPTION OF THE DRAWINGS

4.0 DETAILED DISCLOSURE

This disclosure involves a novel system for extending the height of cubicle walls. The system is inexpensive and does not require replacement of existing walls, nor the attendant costs involved in disassembly and installation under current cubicle systems. Moreover, the system can be installed quickly with very little interruption to the occupants of the cubicles, keeping downtime at a minimum.

Figure 1:
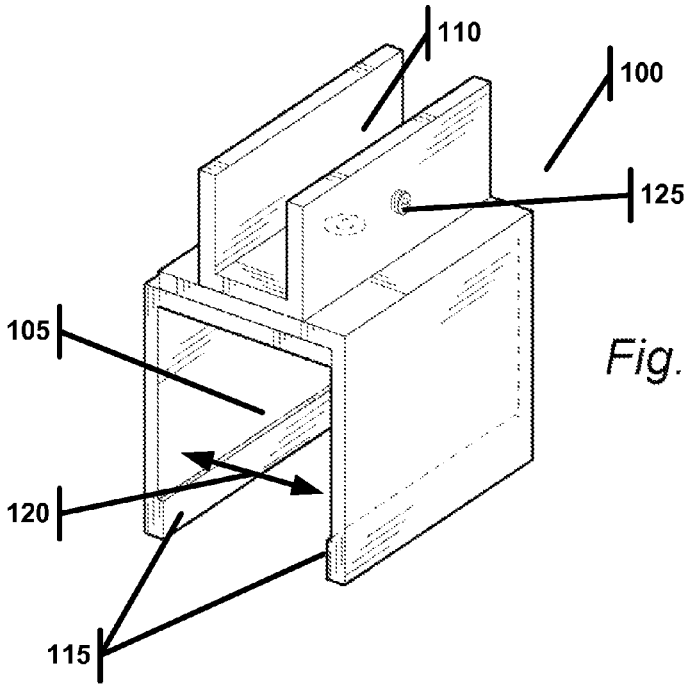
FIG. 1 illustrates a novel clamp for extending cubicle office walls.

FIG. 1 illustrates the novel clamp (100) used in the system. The clamp (100) contains a lower channel (105) and an upper channel (110). The lower channel (105) is adapted to mount on the existing cubicle wall (shown in FIG. 5). The walls of the lower channel may be textured to provide a better grip to the existing cubicle wall. The lower channel (105) optionally has protrusions (115) that "bite" into the existing cubicle wall, providing for a much more stable mount. The protrusions (115) may also be textured. The lower channel (105) is adjustable in width (see arrow 120) to accommodate various thicknesses of existing cubicle walls, and also to allow the clamp to constrict on the existing cubicle wall to form a stable mount.

Figure 2:
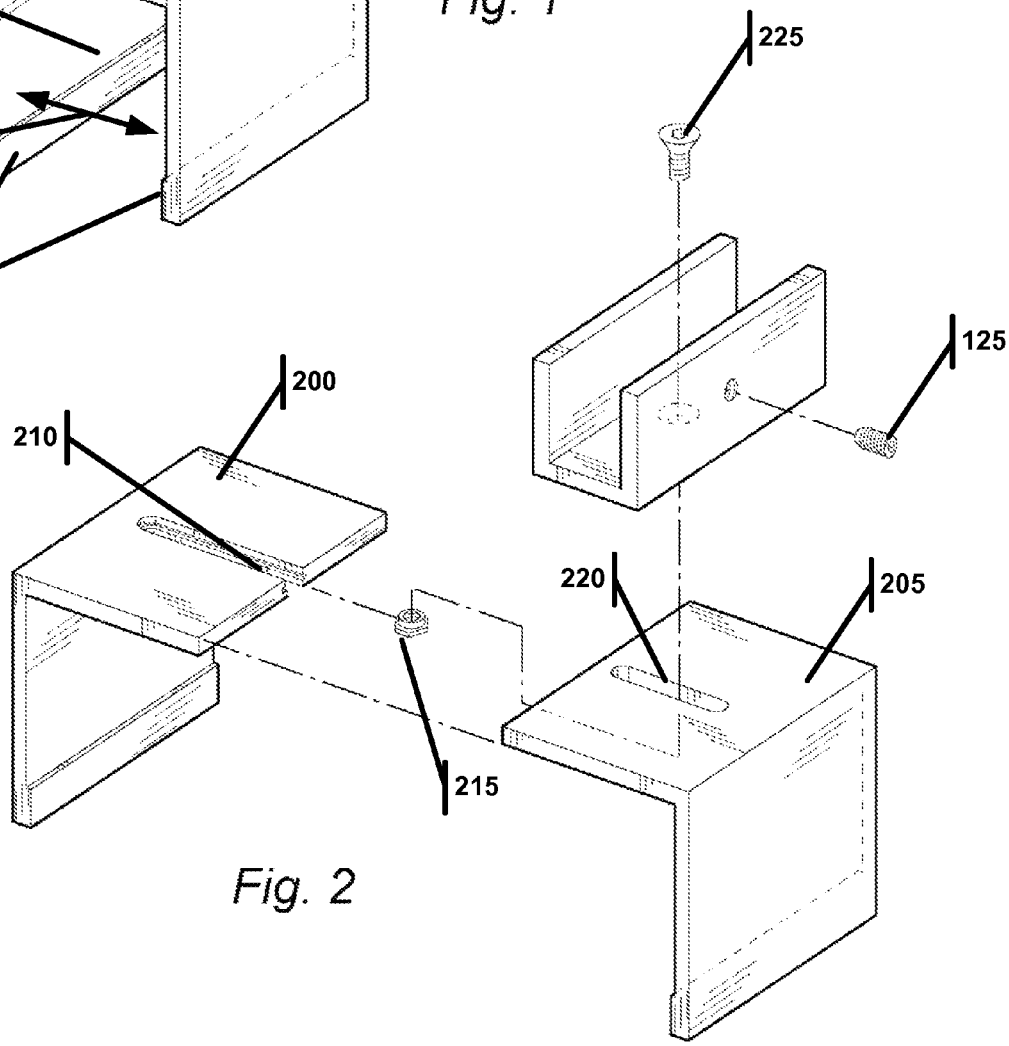
FIG. 2 illustrates the clamp shown in FIG. 1 disassembled.
Figure 3:
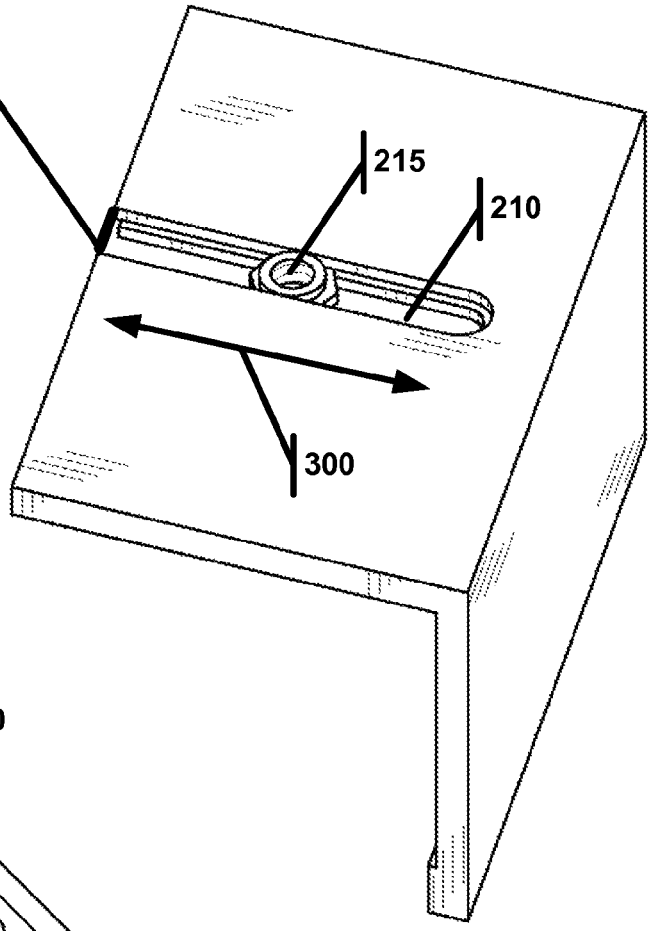
FIG. 3 illustrate a portion of the clamp of FIG. 1, illustrating the nut and nut channel.

FIG. 2 illustrates the clamp (100) disassembled, which in turn shows how the lower channel (105) is adjustable. The lower channel may be comprised of two halves (200 and 205). The first half (200) has a nut channel (210) into which is inserted a nut (215). FIG. 3 illustrates the nut channel (210) and the nut (215) disposed within the nut channel (210). The nut (215) is free to move laterally within the nut channel (210) in the direction of arrow (300). The nut (215) however, does not freely spin in the channel. Optionally, the end of the nut channel (210) may be constructed so as to not allow the nut (215) to exit the nut channel (210). This may be done by introducing a plug or wall (305) or by cinching or narrowing the nut channel (210) at the end.

The second half (205) has a slot (220) which allows screw (225) to access the nut (215), fixing the entire clamp together as one assembly. Because of the nut channel (210) and slot (220), halves (205 and 205) may be adjusted relative to each other to result in a variety of different widths of the lower channel (105), and the screw (225) can then be tightened to maintain the selected width of the lower channel (105). And because the nut (215) is restricted from spinning within the nut channel (210), simply turning the screw (225) will fix the entire clamp (100). This feature is important for several reasons. First, it allows for easy installation of the clamp (100) with only one tool. Second, the nut (215) is disposed within the nut channel (210) and therefore will not become dislodged and lost. And third, the clamp (100) may be installed flush to the top of the existing cubicle wall without requiring a gap through which the nut must be accessed, which results in a more stable mount.

Figure 4:
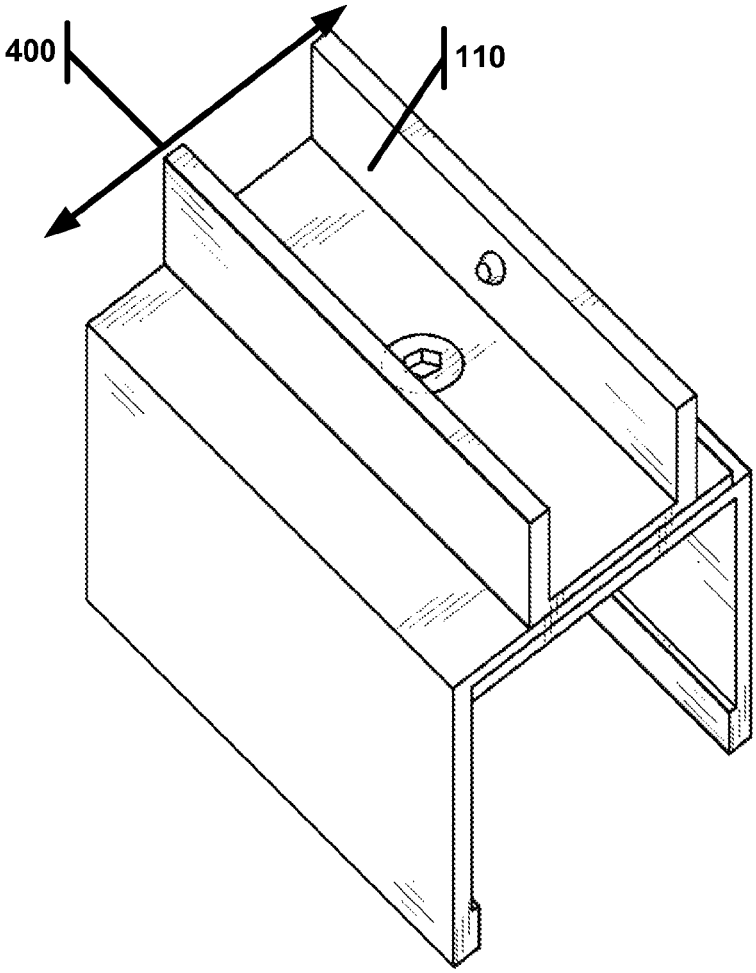
FIG. 4 is a top view of the novel clamp for extending cubicle office walls of FIG. 1.

The upper channel (110) is adapted to receive a vertical wall extender (shown in FIG. 5), the vertical wall extender being a variety of heights and lengths, depending on the customer preference. The vertical wall extender is fixed to the clamp (100) by fixing element (125), which in this embodiment is a screw. So once the vertical wall extender is inserted into the upper channel (110) the fixing element (125) can be tightened, fixing the vertical wall extender to the clamp (100). Optionally, the slot (220) is elongated which allows the upper channel (110) to be adjusted relative to the lower channel, such that it need not be fixed to be centered between the two halves (200 and 205). Referring to FIG. 4, the upper channel (110) can be slid to one side or the other (in the direction of arrow 400). In FIG. 4, the upper channel is slid to be more on the right half of the clamp (100). This feature allows for complete adjustment of the vertical wall extender—it can be placed on center or may be move to one side to create more of a ledge for one of the cubicle occupants.

Installation of the clamp (100) is as follows. The installer would loosen screw (125) opening the lower channel (105) (i.e., sliding halves 200 and 205 away from each other) wide enough to accommodate the existing cubicle wall. Then, the clamp (100) would be placed on the existing cubicle wall. Halves (200 and 205) would be pushed toward each other constricting the lower channel (105) onto the existing cubicle wall, and allowing protrusions (115) to "bite" into the existing cubicle wall. It should be noted that cubicle walls are often made of a solid core covered with stuffing and a fabric exterior, resulting in walls that are soft and indentable like a pillow. Because of this pillow-like compliance, the protrusions (115) can be extremely effective in securely mounting the clamp to the existing cubicle wall. The installer would then adjust the location of the upper channel (110) (i.e., on center or favoring one side). Once those adjustments are made then the screw (225) is tightened. At this point the clamp (100) is fixed to the existing cubicle wall. The installer will repeat this process affixing as many clamps (100) as necessary to provide a stable mount for the vertical wall extender. Once all the clamps (100) are fixed to the existing cubicle wall, then the vertical wall extender can be inserted into the upper channel (110) and the fixing element actuated so as to fix the vertical extender to the clamp (110).

Figure 5:
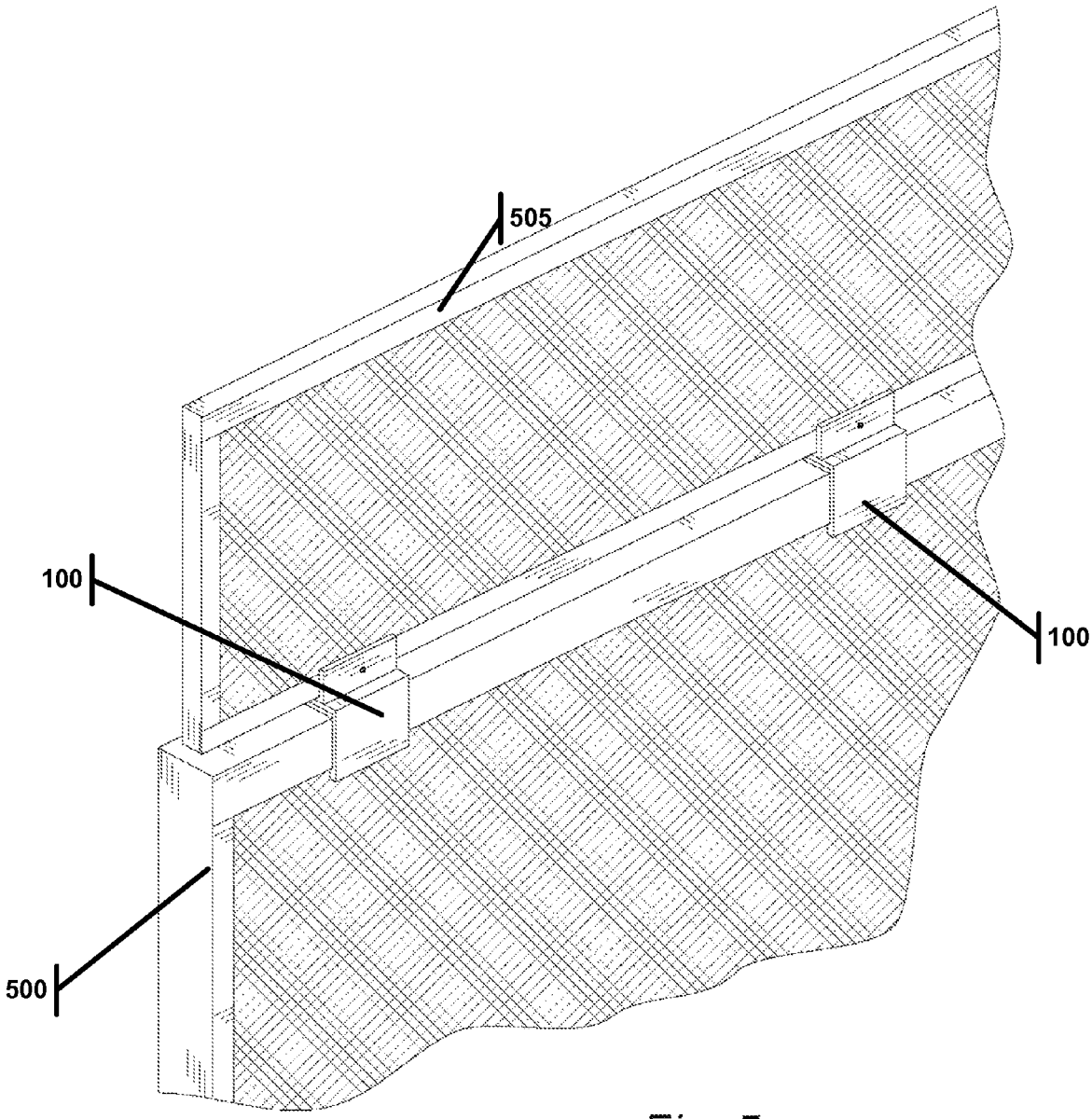
FIG. 5 illustrates the novel clamp for extending cubicle office walls installed.

FIG. 5 illustrates the clamp (100) mounted on an existing cubicle wall (500) with a vertical wall extender (505) mounted to the top channel of the clamp (100).

While particular preferred and alternative embodiments of the present invention have been disclosed, it will be appreciated that many various modifications and extensions of the above described technology may be implemented using the teaching of this patent application. All such modifications and extensions are intended to be included within the true spirit and scope of this patent application.

The invention claimed is:

1. A clamp comprising:

an upper channel adapted to receive a vertical wall extender, the upper channel further comprising a fixing element that fixes the vertical wall extender to the upper channel, and a screw, wherein the upper channel comprises upper channel sides and an upper channel base surface, wherein the screw is generally flush with the base surface when the clamp is installed; and a lower channel adapted to be mounted to an existing cubicle wall, the existing cubicle wall having a top and sides, the lower channel further comprising a first and second half, the first half containing a nut channel with a nut disposed therein, the second half containing an elongate slot through which the screw can thread into the nut, both the nut channel and elongate slot having a longitudinal axis that is perpendicular to the sides of the existing cubicle wall when the clamp is installed, and wherein the two halves are adapted to be fixed into contact with the sides of the existing cubicle wall when the screw is tightened to the nut;

wherein the nut channel is adapted to restrict the nut from spinning during installation and allow the upper channel to be fixed into place at a position along the longitudinal axis of the elongate slot.

2. The clamp of claim 1 wherein either the fixing element or screw is an allen screw.

3. The clamp of claim 1 wherein at least one of the two halves is textured so as to better grip the existing cubicle wall.

4. The clamp of claim 1 wherein at least one of the two halves has a protrusion.

5. The clamp of claim 4 wherein the protrusion is textured so as to better grip the existing cubicle wall.

6. The clamp of claim 1 wherein both halves have a protrusion.

7. The clamp of claim 1 wherein the nut channel comprises a plug to prevent the nut from exiting the nut channel.

8. The clamp of claim 1 wherein the nut channel is narrowed at one end to prevent the nut from exiting the nut channel.

9. The clamp of 1, wherein the fixing element is located on one of the upper channel sides and is adapted to fix the vertical wall extender to the upper channel, and wherein the vertical wall extender is generally flush to the upper channel base surface when so fixed.

10. A system for extending the height of a cubicle wall, the cubicle wall have a top and sides, the system comprising:

a vertical wall extender; and a clamp, comprising:

an upper channel adapted to receive the vertical wall extender, the upper channel further comprising a fixing element that fixes the vertical wall extender to the upper channel, and a screw, wherein the upper channel comprises upper channel sides and an upper channel base surface, wherein the screw is generally flush with the base surface when the clamp is installed; and a lower channel adapted to be mounted to the cubicle wall, the lower channel further comprising a first and second half, the first half containing a nut channel with a nut disposed therein, the second half containing an elongate slot through which the screw can thread into the nut, both the nut channel and elongate slot having a longitudinal axis that is perpendicular to the sides of the existing cubicle wall when the clamp is installed, and wherein the two halves are adapted to be fixed into contact with the sides of the existing cubicle wall when the screw is tightened to the nut;

wherein the nut channel is adapted to restrict the nut from spinning during installation and allow the upper channel to be fixed into place at a position along the longitudinal axis of the elongate slot.

11. The system of claim 10 wherein either the fixing element or screw is an allen screw.

12. The system claim 10 wherein at least one of the two halves has a protrusion.

13. The system of claim 10 wherein both halves have a protrusion.

14. The system of claim 10 wherein the nut channel comprises a plug to prevent the nut from exiting the nut channel.

15. The system of claim 10 wherein the nut channel is narrowed at one end to prevent the nut from exiting the nut channel.

16. A method for extending the height of a cubicle wall, the cubicle wall have a top and sides, the method comprising: providing a vertical wall extender;

providing a clamp, the clamp comprising an upper channel adapted to receive the vertical wall extender, the upper channel further comprising a fixing element that fixes the vertical wall extender to the upper channel, and a screw, wherein the upper channel comprises upper channel sides and an upper channel base surface, wherein the screw is generally flush with the base surface when the clamp is installed; and a lower channel adapted to be mounted to the cubicle wall, the lower channel further comprising a first and second half, the first half containing a nut channel with a nut disposed therein, the second half containing an elongate slot through which the screw can thread into the nut, both the nut channel and elongate slot having a longitudinal axis that is perpendicular to the sides of the existing cubicle wall when the clamp is installed, and wherein the two halves are adapted to be fixed into contact with the sides of the existing cubicle wall when the screw is tightened to the nut;

wherein the nut channel is adapted to restrict the nut from spinning during installation and allow the upper channel to be fixed into place at a position along the longitudinal axis of the elongate slot;

adjusting the first and second halves so as to receive the cubicle wall;

sliding the first and second halves towards each other;

adjusting the position of the upper channel;

tightening the screw;

inserting the vertical wall extender into the upper channel; and actuating the fixing element.

* * * * *